US005458457A

United States Patent [19]

Goto et al.

[11] Patent Number: 5,458,457

[45] Date of Patent: Oct. 17, 1995

[54] TURBOMACHINE

[75] Inventors: Akira Goto; Tatsuyoshi Katsumata; Masanori Aoki, all of Kanagawa, Japan

[73] Assignee: Ebara Corporation, Tokyo, Japan

[21] Appl. No.: 108,618

[22] PCT Filed: Oct. 2, 1992

[86] PCT No.: PCT/JP92/01280

§ 371 Date: Aug. 26, 1993

§ 102(e) Date: Aug. 26, 1993

[87] PCT Pub. No.: WO93/07392

PCT Pub. Date: Apr. 15, 1993

[30] Foreign Application Priority Data

Oct. 4, 1991 [JP] Japan ..... 3-283742

[51] Int. Cl.[6] ..... F01D 11/00

[52] U.S. Cl. ..... 415/115; 415/116

[58] Field of Search ..... 415/115, 116, 415/914

[56] References Cited

U.S. PATENT DOCUMENTS

| | | | |
|---|---|---|---|
| 3,462,071 | 8/1969 | Garve | 415/116 |
| 3,507,603 | 4/1970 | Von Widdern | 415/116 |
| 4,732,531 | 3/1988 | Minoda et al. | 415/914 |
| 5,154,570 | 10/1992 | Yoshikawa | 415/914 |

FOREIGN PATENT DOCUMENTS

| | | |
|---|---|---|
| 1313594 | 11/1962 | France . |
| 39-13700 | 7/1939 | Japan . |
| 32-3493 | 6/1957 | Japan . |
| 45-14921 | 5/1970 | Japan . |
| 55-35173 | 3/1980 | Japan . |
| 35173 | 3/1980 | Japan . |
| 56-118596 | 9/1981 | Japan . |
| 56-167813 | 11/1981 | Japan . |
| 2191606 | 12/1987 | United Kingdom . |

OTHER PUBLICATIONS

Takata, "The Newest Fluid Technology of Turbomachinery and the Topics", *Stalling Control Technology of Compressors,* Japan Machinery Society, May 16, 1991.

Kaneko et al., "The Improvements, of the Unstable Characteristics of the Low Capactiy Area of High Specific Speed Diagonal–Flow Fan by Front Annular by Wing", Feb. 1992, N. Rajaratnam, Turblent Tests, Trans Nomura Yasumasa, Morikita Shuppan, Inc.

*Primary Examiner*—John T. Kwon
*Attorney, Agent, or Firm*—Wenderoth, Lind & Ponack

[57] ABSTRACT

In a turbomachine having an impeller rotating in a casing, nozzles are provided for forming an annular layer of fluid flowing along the inner surface of the casing. The annular flow layer is formed continuously or intermittently under control by detecting the occurrence of unstable characteristics of the turbomachine or a precursor of unstable characteristics, created by conditions represented by a positively-sloped region of the head-capacity curve of the turbomachine.

26 Claims, 13 Drawing Sheets

E–E SECTION

MERIDIONAL SECTION

E–E SECTION

Fig. 2
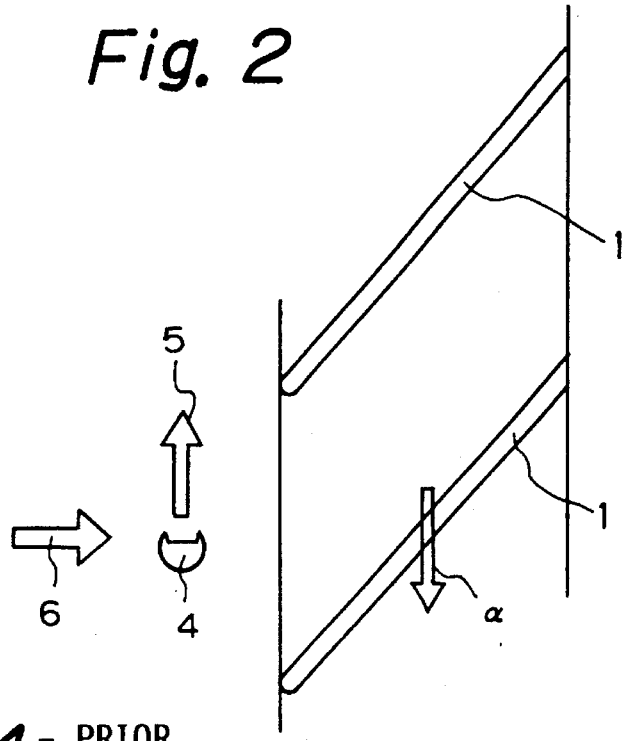
Fig. 4 - PRIOR ART
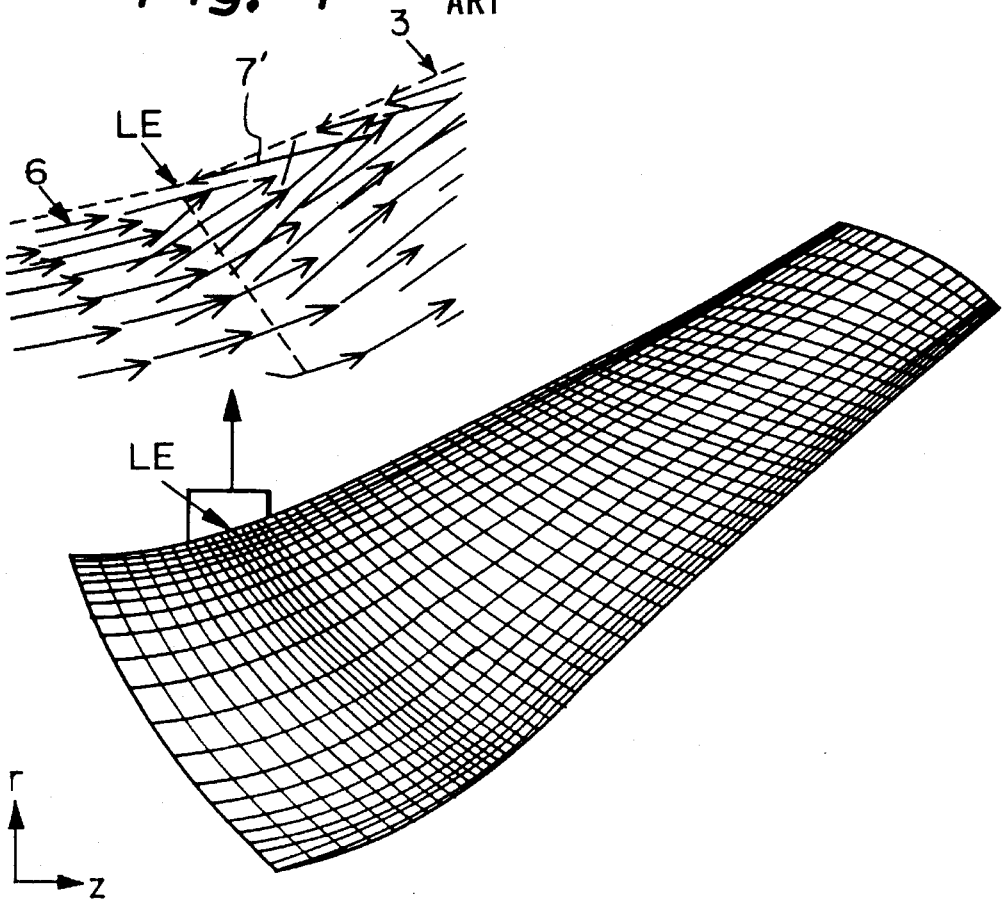

Fig. 3 (a) - PRIOR ART
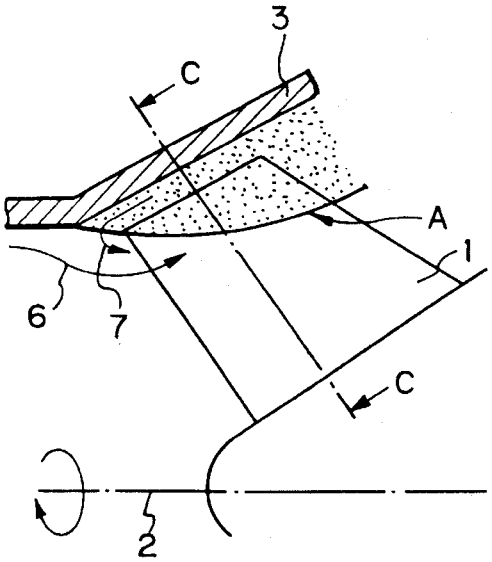
Fig. 3 (b) - PRIOR ART
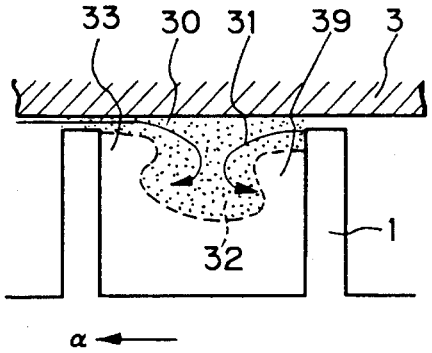
C—C SECTION
Fig. 3 (c) - PRIOR ART
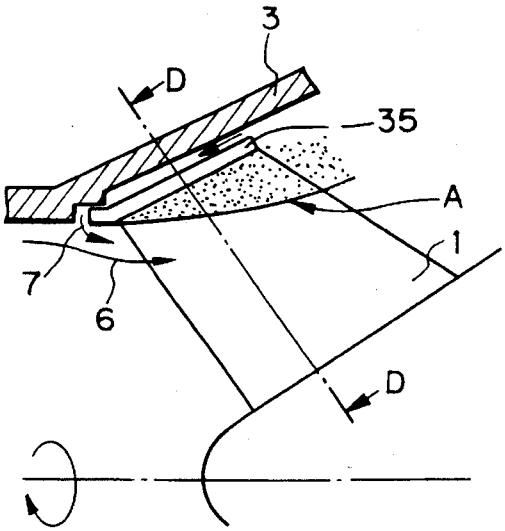
Fig. 3 (d) - PRIOR ART
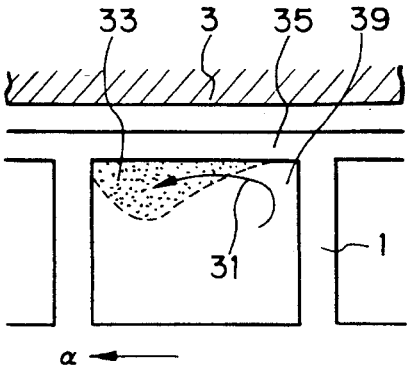
D—D SECTION Fig. 5 - PRIOR ART
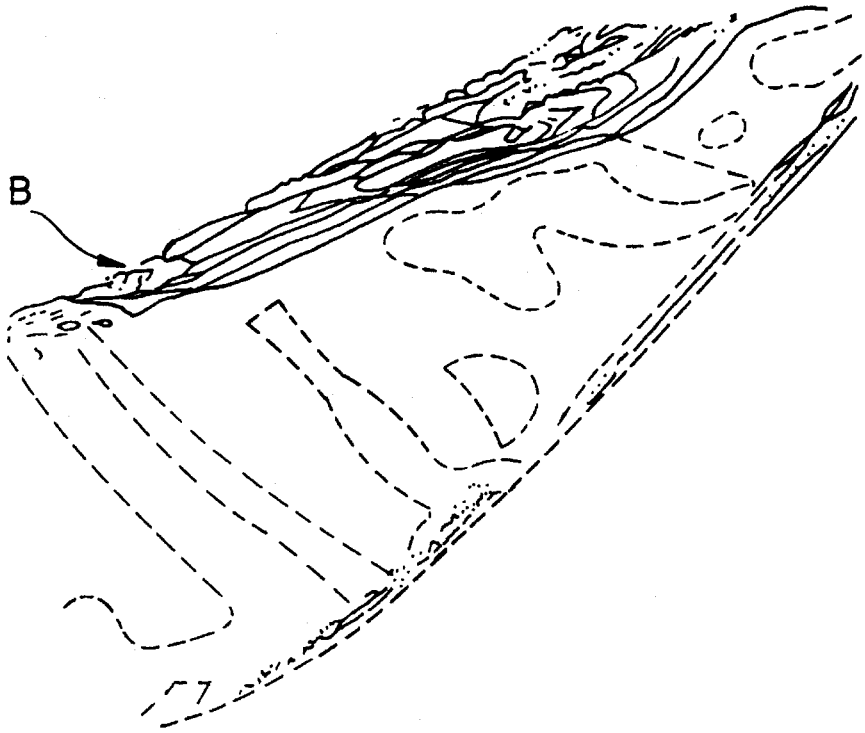
Fig. 6
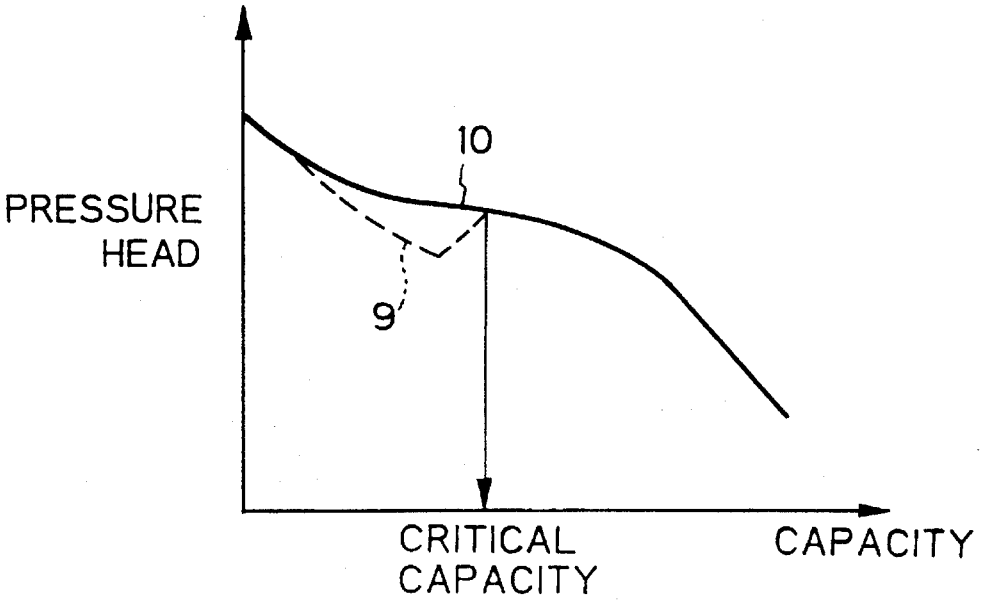

E–E SECTION

TURBOMACHINE

BACKGROUND OF THE INVENTION

1. Field of the Invention

The present invention relates to a turbomachine and, more particularly, to a turbomachine which is designed to prevent conditions giving rise to positively-sloped head-capacity characteristics, which would otherwise be observed in the head-capacity curve while the machine operates below maximum capacity, or which exhibits the positively-sloped head-capacity characteristics only over a portion of its capacity, whereby the turbomachine has a stable operation.

2. Description of the Related Art

FIGS. 3(*a*) and 3(*c*) each show an impeller part of a respective conventional turbomachine. FIG. 3(*a*) shows the impeller part of a turbomachine having an open impeller without a front shroud, while FIG. 3(*c*) shows the impeller part of the turbomachine having a closed impeller with a front shroud. FIGS. 3(*b*) and 3(*d*) are sectional views taken along lines C—C and D—D in FIGS. 3(*a*) and 3(*c*), respectively. As is illustrated in the figures, as an impeller 1 rotates inside a casing 3 about an axis 2 of rotation, a fluid is sucked into the casing 3 from a suction port (not shown) and is discharged into a discharge port (not shown).

In the conventional turbomachinery of the type described above, a large-scale separation of flow occurs due to an unstable high-loss fluid, that is, a low-momentum fluid, on the blade surface, the casing and/or the shroud. As a result, a head-capacity curve having a positive slope appears in a partial capacity range, as shown by the broken line 9 in FIG. 6. Such positively-sloped characteristics of the head-capacity curve are also known as a stall phenomenon, which may induce surge, that is, self-induced vibration of a turbomachine piping system, and which may also cause vibration and noise and damage the apparatus. Thus, the stall phenomenon is a serious problem to be solved in obtaining a stable operation of turbomachinery.

The means for solving such a problem may be roughly divided into passive means that are not supplied with energy from the outside of the turbomachine, and active means that are supplied with some energy from the outside of the turbomachine.

Known passive means include casing treatment in which grooves are provided in the inner wall of the casing, and an annular passage with straightening vanes provided inside a part of the casing at the impeller inlet part (see the teaching material for the 181st course sponsored by the Kansai Branch of the Japan Society of Mechanical Engineers, pp. 45–56). These means suffer, however, from the problem that although the effectiveness of the turbomachinery during operation in a partial capacity range is enhanced, the efficiency during the normal operation is accordingly lower.

Further, a means which bypasses fluid from the discharge side toward the inlet side during operation in the partial capacity range is widely employed. However, this means increases the actual capacity of the fluid flowing through the turbomachine, and it inevitably causes a marked reduction in the pump head of the turbomachine. In addition, since a large amount of fluid flows back through the bypass, a great deal of power is consumed disadvantageously.

On the other hand, the conventional active means may be roughly divided into the following four types:

(1) Means for externally supplying energy to the low-momentum fluid on the blade surface, the casing and/or the shroud;

(2) Means for removing such a low-momentum fluid;

(3) Means for imparting a prerotation to the impeller inlet flow, rotating in the direction of the impeller rotation, to thereby prevent blade stalling; and (4) Means for actively generating disturbances to dump a wave mode of unstable fluid oscillation that appears in the flow field before stalling occurs.

As one example of the means (1), Japanese Patent Application Public Disclosure No. 55-35173 (1980) discloses a method in which part of the high-pressure side fluid is introduced to the tip of the impeller and/or the area inbetween each pair of adjacent blades in the form of a high-speed jet. According to this literature, the jet may be injected in the radial direction, the direction of rotation of the impeller or the direction counter to the impeller rotation, and this literature claims that the jet is equally effective when injected in any of these three directions. Since the function of the jet in this prior art is to supply energy to the unstable low-momentum fluid on the blade surface and to thereby prevent boundary-layer separation, the direction of injection need not particularly be taken into consideration.

As another known example, Japanese Patent Application Public Disclosure No. 45-14921 (1970) discloses a method in which high-pressure air is taken out from the discharge side of a centrifugal compressor and is jetted out from a nozzle provided in a part of the casing that covers the rear half of the impeller to thereby stabilize the pump while operating at partial capacity. The function of the jet in this prior art is to create a turbine effect whereby pressure is supplied to the low-pressure region at the rear part of the blade (blade suction surface side), and a jet flap effect whereby the effective passage width at the impeller exit is reduced. Accordingly, the jet needs to have a circumferential velocity component in the direction of the impeller rotation and also a velocity component in the direction perpendicular to the casing wall surface.

As one example of the means (2), Japanese Patent Application Public Disclosure No. 39-13700 (1964) discloses a means by which a fluid is returned from the high-pressure stage side to the low-pressure stage side in an axial flow compressor to draw low-momentum fluid, which is present inside the boundary layer, along the casing wall at the high-pressure stage side, thereby stabilizing the flow. In this prior art, the return fluid in the low-pressure stage acts as a jet so as to supply momentum to the fluid in the vicinity of the wall surface, thereby also providing the same function as that of the above-described means (1).

As one example of the means (3), Japanese Patent Application Public disclosure No. 56-167813 (1981) discloses an apparatus for preventing surface in a turbo-charger, in which air is injected from an opening facing tangentially to the direction of rotation of the impeller at the impeller inlet. It is stated in this literature that the function of the injected air is to impart a prerotation to the flow so as to reduce the angle of attack of the flow relative to the blades, thereby preventing separation on the blade surface. Accordingly, the direction in which the air is injected is defined as being the same as the direction of rotation of the impeller and tangential to it. This necessitates imparting a prerotation to the flow over a relatively wide range of the blade height in order to prevent stalling over a significant range of partial capacity of the pump and inevitably results in a reduction in the pressure head.

As one example of the means (4), UK Patent Application GB 2191606A discloses a method in which an unstable, fluctuating wave mode in the flow field is measured and, while doing so, the amplitude, phase, frequency, etc. of the wave mode are analyzed, and a vibrating blade, vibrating wall, an intermittent jet, etc. are used as an actuator to actively impart to the fluid such a wave disturbance as to cancel the above-described unstable wave mode, thereby preventing stalling, surge, pressure pulsation, etc. This method is based on the assumption that there is an unstable wave motion as a precursor of stall, surge, etc., and hence cannot be applied to turbomachinery in which such a wave motion is not present.

SUMMARY OF THE INVENTION

The inventors of this application conducted detailed studies of turbomachinery of the type described above and, as a result, have clarified the fact that the creation of the conditions giving rise to the positively-sloped head-capacity characteristics (i.e., stalling) depends not simply on the magnitude of the flow loss but also on the pattern of distribution of such a high-loss fluid, that is, a low-momentum fluid, inside the impeller. A high-loss fluid that is generated inside the impeller accumulates in a corner region between the blade suction surface and the casing (or the shroud) due to the action of the secondary flow inside the impeller. In mixed flow turbomachinery wherein a relatively strong passage vortex 31 is generated, the above-described high-loss fluid accumulates in a corner portion 33 closer to the blade suction surface. On the other hand, in axial flow turbomachinery wherein the passage vortex is relatively weak, because a blade tip leakage vortex 30, which whirls in a direction counter to the passage vortex, is dominant, the high-loss fluid is likely to accumulate in a corner region 39 closer to the blade pressure surface [see FIGS. 3(*a*), 3(*b*), 3(*c*) and 3(*d*)]. In either type of turbomachinery, a large-scale separation occurs in such a corner region, causing positively-sloped head-capacity characteristics to be induced.

In view of the above-described circumstances, it is an object of the present invention to provide a turbomachine wherein only the pattern of distribution of the high-loss fluid inside the passage is changed by controlling the secondary flow inside the impeller, thereby inhibiting high-loss fluid from accumulating in the above-described corner regions, and thus making it possible to prevent the occurrence of conditions giving rise to positively-sloped head-capacity characteristics, which would otherwise be observed in the head-capacity curve of the turbomachine, and hence to prevent surging.

BRIEF DESCRIPTION OF THE DRAWINGS

FIG. 2 is a developed view of a stream surface in the vicinity of the casing in FIG. 1;

FIG. 3 shows a flow in the vicinity of the inlet in conventional turbomachinery, in which FIG. 3(*a*) is a sectional view, FIG. 3(*b*) is a sectional view taken along line C—C in FIG. 3(*a*), FIG. 3(*c*) is a sectional view, and FIG. 3(*d*) is a sectional view taken along line D—D in FIG. 3(*c*);

FIG. 4 shows a result of numerical simulation by a three-dimensional viscous flow computation in the case of the turbomachinery shown in FIG. 3;

FIG. 5 shows a result of numerical simulation by a three-dimensional viscous flow computation in the case of the turbomachinery shown in FIG. 3;

FIG. 6 shows the head-capacity curve (pump head-capacity) of turbomachinery;

DETAILED DESCRIPTION OF THE PREFERRED EMBODIMENTS

Figure 1A:
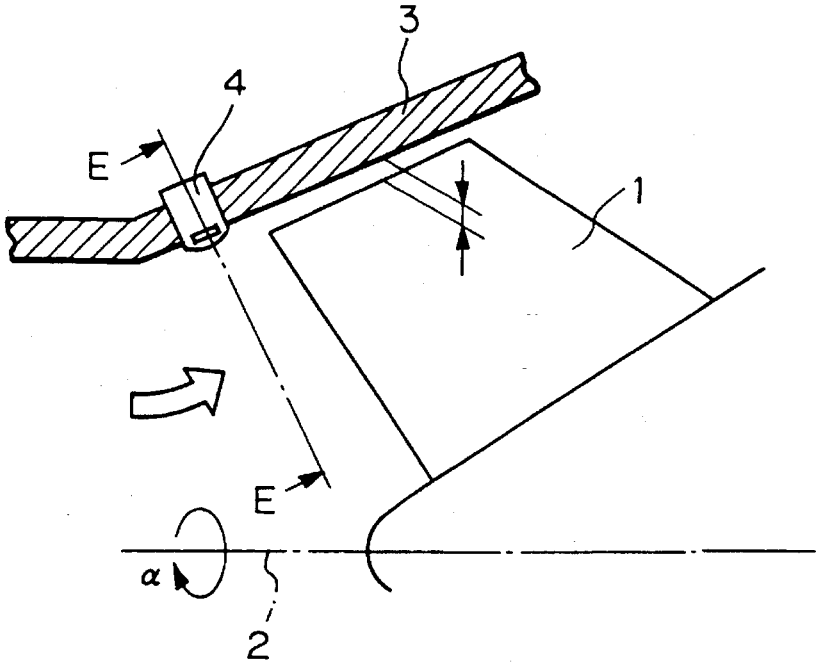
FIG. 1 shows the inlet part of the turbomachine according to the present invention, in which FIG. 1(*a*) is a sectional view taken along a meridional plane, and FIG. 1(*b*) is a sectional view taken along line E—E in FIG. 1(*a*)
Figure 1B:
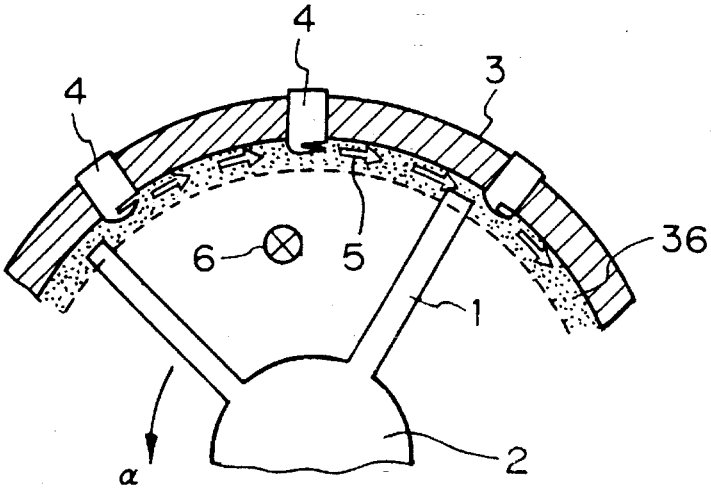

The present invention provides a turbomachine having an impeller 1 with or without a shroud, which rotates inside a casing 3, as shown in FIG. 1, and which is characterized by providing means for forming an annular layer of fluid 36 flowing substantially at right angles to the impeller inlet flow and circumferentially along the inner wall of the casing 3, a detector detecting unstable characteristics or a precursor thereof, namely for detecting when the head-capacity curve of the turbomachine shows positively-sloped, unstable characteristics, and a controller for controlling the means so that the above-described annular flow layer is formed continuously or intermittently in the flow field to thereby control the secondary flow inside the impeller.

The present invention is also characterized in that the direction of rotation of the annular layer of fluid flow 36 is developed counter to or in the same direction as the direction α of rotation of the impeller in accordance with the flow condition (secondary flow pattern) inside the impeller.

The specific means for forming the above-described annular flow layer 36 in the flow field are nozzles 4 for injecting jets along the inner wall of the casing 3, which nozzles are provided inwardly of the inner wall of a part of the casing at the impeller inlet, thereby generating a vortex sheet at the boundary between the inlet flow and the annular flow layer 36.

Thus, according to the present invention, the means for forming an annular flow layer along the inner wall of the casing, at about the time the head-capacity curve of the turbomachine becomes so positively-sloped as to represent unstable characteristics, changes the secondary flow pattern so as to inhibit high-loss fluid from accumulating in the above-described corner region and thereby prevent large-scale separation inside the impeller. Hence, a pump surge is prevented, and thus the turbomachine operates stably over the entire capacity range thereof. This will be explained below more specifically.

The effectiveness of the above-described prior art active means (1) which supplies energy to the unstable flow, relies on the total energy (the kinetic energy of the jet multiplied by the flow rate of the jet) that is supplied to the flow field, which is considered to be proportional to the cube of the jet velocity.

In contrast, the present invention aims at improving the head characteristics with a vortex sheet, and it has been experimentally confirmed that the effectiveness thereof is proportional to the intensity of the vortex layer, that is, to the first power of the jet velocity. Thus, the present invention is fundamentally different from the use of the prior art type of active means (1).

Further, the present invention differs from the active means (1) in that the direction of jet injection is essential. Specifically, the jets must be injected substantially at right angles to the inlet flow and circumferentially along the casing inner wall in order to form the vortex sheet most effectively.

Figure 20:
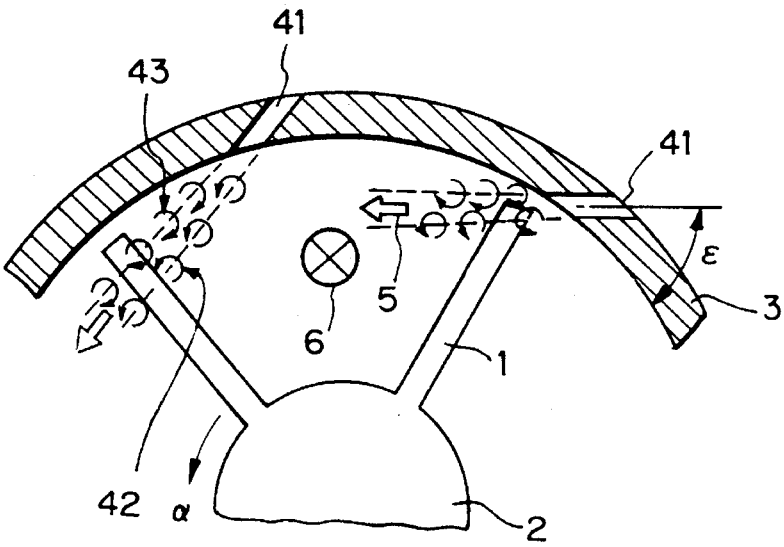
Fig. 20 PRIOR ART
FIG. 20 shows one example of injection of jets in a conventional turbomachine.

The prior art disclosure is accompanied by a drawing in which nozzles 41 are shown extending through the casing 3 to inject jets at a certain angle (ε) relative to the inner wall surface of the casing 3 (FIG. 20). In this case, the jets are injected away from the casing inner wall surface.

Figure 16:
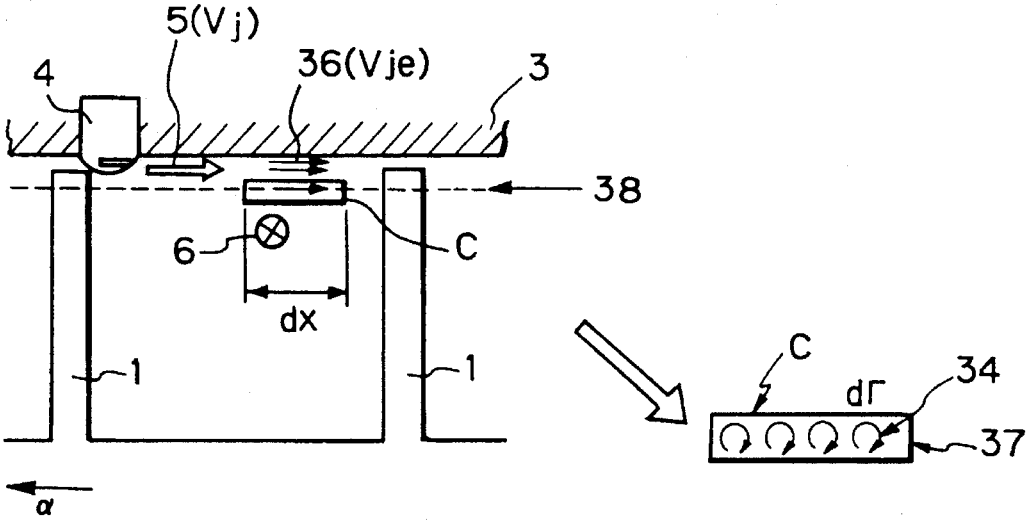
FIG. 16 illustrates a mechanism for introducing a vortex into the flow field of a turbomachine.

In the present invention, as will be explained later, a flow layer that flows in the same direction as or counter to the direction of rotation of the impeller 1 is formed along the inner wall of the casing 3 in accordance with the secondary flow pattern inside the impeller 1 [FIG. 1(*b*)], and a sheet of vortices whirling in a specific direction of rotation is generated at the velocity discontinuity along the flow layer, as shown in FIG. 16. In contrast to this, in the prior art shown in FIG. 20, vortex sheets 42 and 43 which have respective groups of vortices rotating in different directions are simultaneously generated at both sides of each jet. Therefore, one vortex sheet 43 inevitably acts to deteriorate the flow field, thus making it impossible to expect an advantageous effect such as that obtained in the present invention.

In addition, a jet that does not flow along the inner wall surface of the casing 3 as in the case of FIG. 20 disturbs the inlet flow 6 and further increases the angle at which the flow incides on the blades, which may induce a separation of the flow. Thus, the above-described prior art may in fact denigrate the pump performance.

The active means (2) only removes the low-momentum fluid itself, whereas, in the present invention, only the distribution of low-momentum fluid in the flow passage is controlled.

In the method carried out by the active means (3), the inlet flow is prerotated in the direction of rotation of the impeller. According to the present invention, however, it is impossible to improve the head-capacity characteristics of mixed flow turbomachinery, in which a strong passage vortex is generated, unless an annular flow layer rotating counter to the direction of rotation of the impeller is formed and a sheet of vortices whirling in a direction counter to the direction of rotation of the impeller is generated.

In an experiment made in connection with the present invention, an annular flow layer flowing in the direction of rotation of the impeller was formed to produce a sheet of vortices whirling in the direction of rotation of the impeller. As a result, the positive slope of the head-capacity curve and stalling were mitigated to a considerable extent.

On the other hand, in axial flow turbomachinery, in which the passage vortex is relatively weak, the head-capacity characteristics cannot be improved unless an annular flow layer, flowing counter to the direction in the case of the mixed flow turbomachinery, is formed and a sheet of vortices whirling in the direction of the impeller rotation is generated. Accordingly, the gist of the present invention resides in that an annular flow layer flowing in a direction counter to or the same as the direction of the rotation of the impeller is formed in accordance with the condition of flow around the impeller, and in this point the present invention differs markedly from the conventional active means in which the direction of prerotation is specified as being the same as the direction of the impeller rotation.

In addition, it is possible according to the present invention to produce an adequate effect simply by forming a very thin annular flow layer along the casing inner wall. Therefore, there will be no reduction in the pump head due to prerotation as in the conventional means.

Whereas the active means (4) is based on the assumption that there is a wave mode of an unstable flow, as stated above, the present invention does not need the presence of such a wave mode. Many types of turbomachines for general use have no fluctuating wave mode as a precursor of the occurrence of positively-sloped head-capacity characteristics or stalling, and the present invention can be effectively applied to these turbomachines. This is an advantageous feature of the present invention.

The present invention also has the advantageous feature that the characteristics in the partial capacity range can be improved without impairing the turbomachine efficiency during the normal operation.

In conventional mixed flow turbomachinery, phenomena such as those shown in FIGS. 3(*b*) and 3(*d*) occur at the region of the impeller 1. That is, in the open impeller without a shroud, shown in FIG. 3(*b*), the tip leakage vortex 30 that flows through the clearance between the blade tip of the impeller 1 and the casing 3 interferes with the passage vortex 31 flowing from the blade pressure surface toward the suction surface, so that the high-loss fluid inside the impeller 1 accumulates in a region 32 of interaction of these vortices. As the capacity decreases, the clearance flow 7, which flows backward in the upstream direction through the clearance between the blade tip of the impeller 1 and the casing 3, becomes stronger, resulting in an increase in the inlet boundary layer thickness (high-loss region) on the casing 3 due to the interaction of the clearance flow 7 with the inlet flow 6. Consequently, the passage vortex 31 is sustained.

FIGS. 4 and 5 show the results of a simulation of the above-described situation based upon numerical computations of a three-dimensional viscous flow. It is observed that the clearance flow 7 between the blade tip of the impeller 1 and the casing 3 induces a reverse flow 7' in the vicinity of the casing 3 (see FIG. 4), and hence the boundary layer (high-loss region) on the casing 3 rapidly develops in this region (see the part B in FIG. 5). It should be noted that LE in FIG. 4 represents the blade leading edge. As the capacity decreases and hence the pressure difference between the blade pressure and suction sides increases, the clearance flow 7 becomes stronger, and consequently the passage vortex 31 develops, causing the high-loss fluid 32 to move to the corner region 33 between the blade suction surface and the casing 3, resulting in a flow pattern in which a large-scale corner separation is likely to occur.

In the closed impeller with a shroud, shown in FIG. 3(*d*), there is no tip leakage vortex 30 to act counter to the passage vortex 31. Therefore, the high-loss fluid on the shroud 35 is present in the corner region 33 between the blade suction surface and the shroud 35 from the beginning, thus forming a flow pattern in which a large-scale corner separation is likely to occur in a larger capacity region than in the case of the open impeller.

In conventional axial flow turbomachinery, the fluid mainly flows substantially parallel to the axis of rotation. Therefore, the Coriolis force is relatively weak, so that the intensity of the passage vortex 31 is considerably lower than in the case of the mixed flow turbomachinery.

In the meantime, the intensity of the blade tip leakage vortex 30 increases as the capacity decreases. As a result, the high-loss fluid 32 moves to a corner region 39 defined between the blade pressure surface and the casing 3, thus forming a flow pattern in which a large-scale corner separation is likely to occur.

As has been described above, the occurrence of positively-sloped head-capacity characteristics is closely related not only to the magnitude of the flow loss but also to the flow pattern that is responsible for where the high-loss fluid accumulates in the passage.

If a large-scale corner separation such as that shown by A in FIG. 3(*a*), 3(*c*) or 19(*a*) occurs in the corner region 33 or 39 of the turbomachine impeller 1, the head-capacity curve becomes positively-sloped as shown by the broken line 9 in FIG. 6. When these characteristics are present it is very difficult to achieve a stable operation of the turbomachinery.

In view of these circumstances, the present invention provides the following improvements.

In the case of a mixed flow turbomachine, means are provided for forming an annular layer of fluid flowing counter to the direction of rotation of the impeller 1 along the inner wall of the casing 3 so as to generate a sheet of vortices whirling in a direction counter to the direction of rotation of the impeller 1 at the boundary between the inlet flow 6 and the annular flow layer, thereby suppressing the development of the passage vortex 31 in the direction of rotation of the impeller 1 and causing the high-loss fluid to accumulate at a position away from the corner region 33, and thus preventing a large-scale corner separation.

In the case of a mixed flow open impeller without a shroud, the sheet of vortices that is created by the present invention promotes the development of the tip leakage vortex 30 which whirls in a direction counter to direction of rotation of the impeller. Therefore, the high-loss fluid that accumulates in the interaction region 32 between the passage vortex and the tip leakage vortex 30 moves is rather remote from the corner region 33. Thus, a corner separation can be effectively prevented.

In the case of an axial flow turbomachine, means are provided for forming an annular layer of fluid flowing in the same direction as the direction of rotation of the impeller 1 along the inner wall of the casing 3 so as to generate a sheet of vortices whirling in the direction of rotation of the impeller 1 at the boundary between the inlet flow 6 and the annular flow layer 36, thereby promoting the development of the passage vortex 31 in the direction of rotation of the impeller 1, suppressing the tip leakage vortex 30 and causing the high-loss fluid to accumulate at a position away from the corner region 39, and thus preventing a large-scale corner separation.

In the present invention, the annular flow layer, which induces the vortices, is formed by jets in the inlet part of the impeller 1. FIG. 16 is an enlarged view of an annular flow layer formed along the casing near the impeller inlet part as viewed from the suction port side, showing a mechanism for introducing a sheet of vortices into the flow field.

The figure shows one example in which the inlet flow is perpendicular to the plane of the drawing, and a jet 5 that is injected counter to the direction of rotation of the impeller 1 forms an annular flow layer 36 which is perpendicular to the inlet flow. In this case, at the boundary surface 38 of the annular flow layer 36 the velocity varies discontinuously, thus forming a sheet of vortices. To evaluate the intensity of vortices present along the boundary 38, circulation $d\Gamma$ is integrated along a closed curve C that surrounds a boundary part of length dx to obtain an intensity $\gamma$ of vortices per unit length as follows:

$$\gamma=d\Gamma/dx=(1/dx)\int_c V dc=C_{je}$$

In the above expression, the velocity $V_{je}$ is the flow velocity inside the annular flow layer 36, which has become lower than the velocity $V_j$ of the jet 5 immediately after the injection because of the decay of the jet.

In a case where an inlet guide vane or a suction casing is present upstream of the impeller, the impeller inlet flow enters the impeller with a circumferential velocity component. In this case, the intensity of vortices generated at the boundary between the inlet flow 6 and the annular flow layer 36 is proportional to the velocity component of the jet 5 perpendicular to the inlet flow 6.

Accordingly, it is necessary in order to maximize the intensity of vortices generated to form the annular flow layer 36 so as to be substantially perpendicular to the inlet flow 6. When the inlet flow 6 has a circumferential velocity component, the flow layer, which is formed along the casing inner wall surface according to the present invention, assumes not the shape of a ring but that of a spiral. However, there is no difference in the effectiveness of the flow layer, when it is thin, to generate the vortices.

The effectiveness of the present invention is proportional to the intensity of the generated vortices, that is, the first power of the jet velocity, as stated above. This point has been confirmed by experimental results described later. The main results will be described below. The effectiveness of the vortices increases in proportion to the width of the jet. When the flow layer is not perpendicular to the inlet flow 6, the effectiveness decreases correspondingly to the extent to which the flow layer deviates from the direction which is perpendicular to the inlet flow 6. With these points taken into consideration, $\Gamma$, which is used as a parameter for evaluating the effectiveness of the vortices is defined by the following expression:

$$\Gamma=(B.\gamma.\sin\beta)/(L.U_{1t})$$

In the above expression, B is the jet width, and β is the injection angle of the jet measured from the axial direction. The blade length L at the blade tip is employed as a reference length to make Γ a dimensionless quantity, and the peripheral velocity $U_{1t}$ of the blade inlet tip is employed as a reference velocity.

Figure 21:
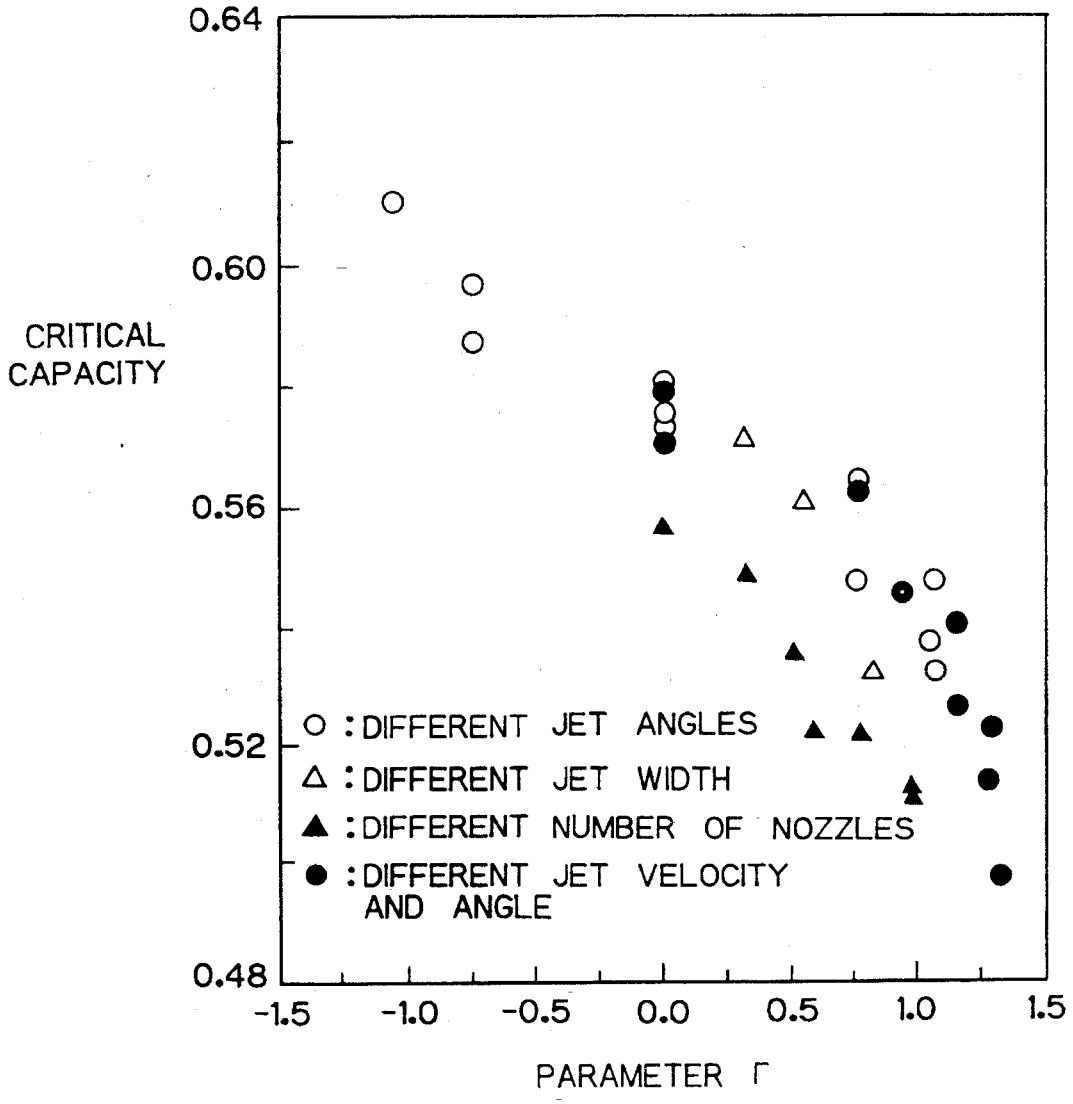
FIG. 21 shows the relationship between the critical capacity and the evaluation parameter Γ.

Experiments were carried out by using various jet angles, jet widths, numbers of nozzles, jet velocities, etc., to determine the relationship between the measured critical capacity at which positively-sloped head-capacity characteristics occurred and the jet evaluation parameter Γ at the critical capacity. The results are shown in FIG. 21.

It will be understood from the figure that the effectiveness of the jet injection can be evaluated by the parameter Γ, and it is proportional to the first power of the jet velocity. As is shown by this fact, the present invention improves the head-capacity characteristics by generating the sheet of vortices, and thus differs from the prior art that is based on the supply of energy (the effectiveness in this case being proportional to the cube of the jet velocity).

As has been described above, vortices are generated along the entire boundary 38 of the velocity discontinuity, thus forming a vortex layer 37 (FIG. 16), and the effectiveness of the present invention is proportional to the intensity of the vortex layer generated, that is, the velocity $V_{je}$ in the annular flow layer.

Figure 17:
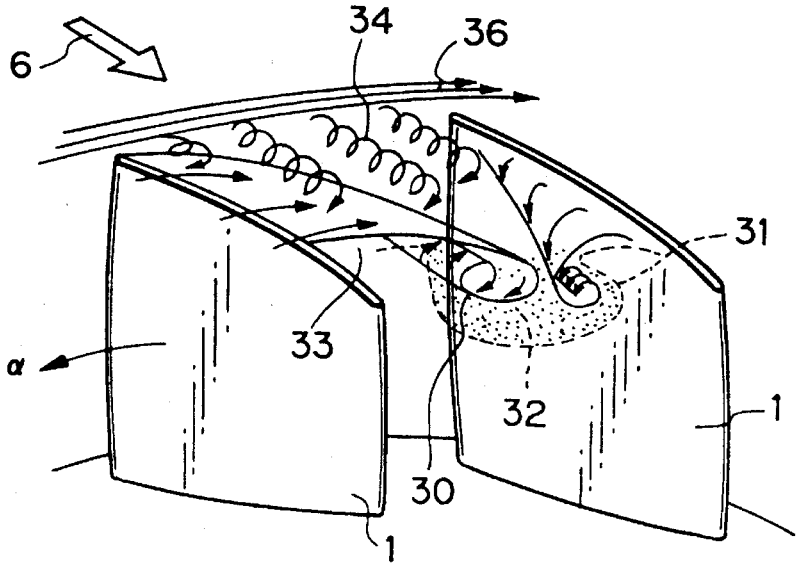
FIG. 17 is a perspective view illustrating the interaction between vortices introduced into the flow field of a turbomachine and the impeller internal flow in an open impeller.

FIG. 17 shows, in three-dimensions, the interaction between the vortices 34 introduced into the flow field and the flow inside the impeller 1 in a mixed flow open impeller.

The vortices 34 are carried into the impeller 1 by the main stream. The vortices 34 interact with the blade tip leakage vortex 30 whirling in the same direction as the vortices 34 to thereby enhance it. On the other hand, the vortices 34 interact with the passage vortex 31 whirling counter to the direction of rotation of the vortices 34 to thereby suppress it. Consequently, the high-loss fluid accumulating in the vortex interaction region 32 is moved to a position away from the corner region 33.

Thus, the introduction of the vortex layer 37 changes the flow pattern of the secondary flow inside the impeller 1, prevents corner separation, and hence eliminates or mitigates positively-sloped head-capacity characteristics of the turbomachine and prevents surge, as stated above.

A specific embodiment in which the present invention is applied to a mixed flow pump will now be described below with reference to the accompanying drawings. FIG. 1 shows the inlet part of the pump according to the present invention, and FIG. 2 is a developed view of a stream surface in the vicinity of the casing in FIG. 1, showing a method whereby jets of water are injected from nozzles. These nozzles are employed as a means for forming an annular layer of fluid flowing along the casing in a direction counter to the direction of rotation of the impeller.

In the pump according to the present invention, nozzles 4 are provided in the casing 3 at a pump inlet. The nozzles 4 inject jets 5, the substance of which is supplied from a high-pressure source, along the inner surface of the casing counter to the direction α of rotation of the impeller 1. The jets flowing along the casing 3 form a surface of discontinuity of velocity (38 in FIG. 16). As a result, a sheet of vortices whirling counter to the direction α of rotation is generated.

The vortices (34 in FIG. 17) generated in this way whirl counter to the passage vortex 31 shown and prevent the high-loss fluid 32 from accumulating in the corner region 33. Thus, it is possible to prevent a large-scale corner separation (stalling of the impeller) such as that shown by A in FIG. 3(*a*) or 3(*c*). Consequently, it is possible to prevent giving rise to the conditions represented by the positively-sloped characteristics, as shown by the solid line 10 in FIG. 6.

Thus, instability represented by the unstable region 9 shown in FIG. 6 can be suppressed by the present invention, i.e. it is possible to attain stable pump characteristics over the entire operating range.

Figure 7:
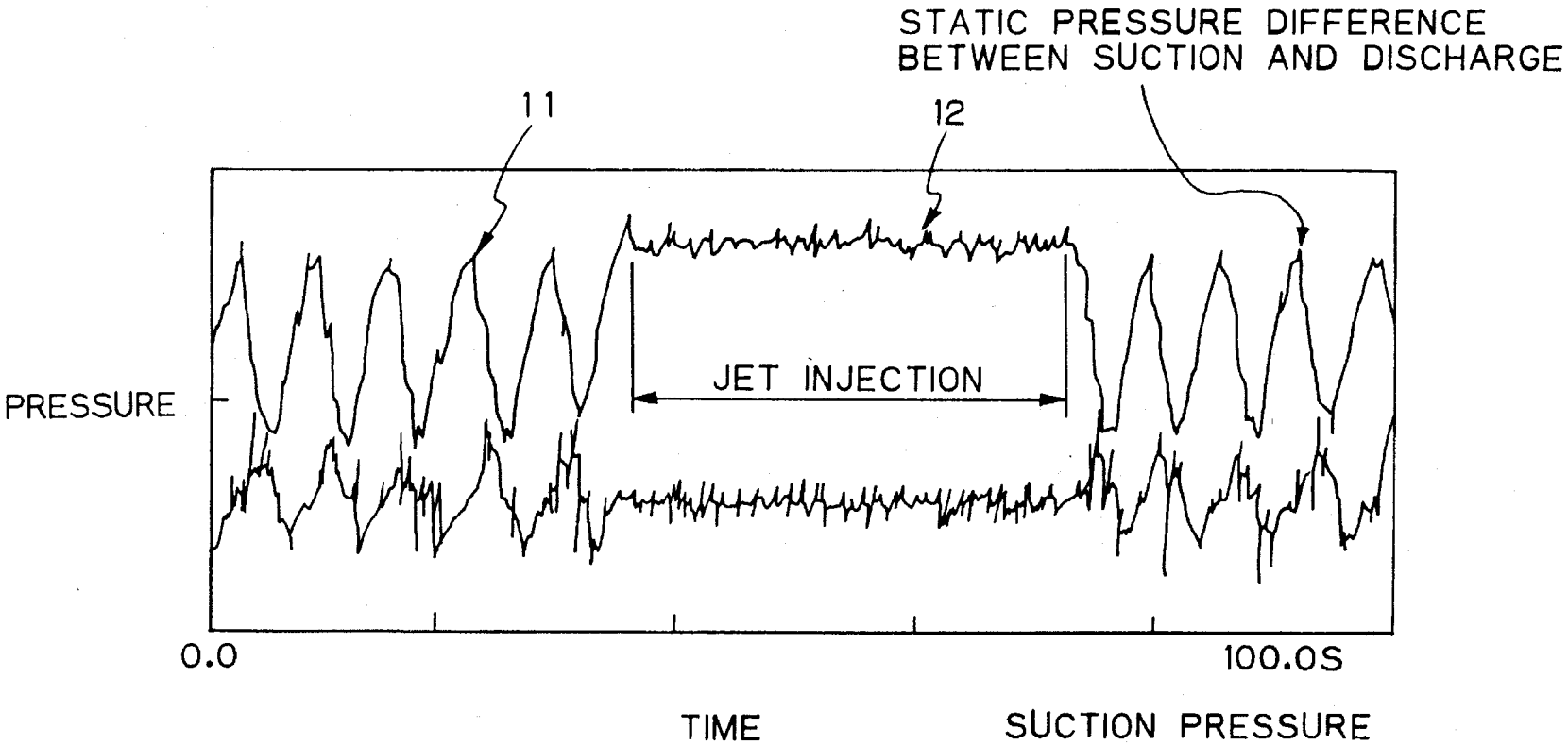
FIG. 7 shows results of an experiment in which jets were injected for a predetermined time under conditions in which surge had already occurred in the pump piping system.

FIG. 7 shows results of an experiment in which jets 5 were injected from the nozzles 4 (jet injection) for a predetermined time under conditions in which surging had already occurred in the pump piping system. As will be clear from the figure, even when an unstable operation condition 11 exists, in which surging occurs so that the discharge pressure fluctuating largely with time, it is possible to recover a stable operating condition 12.

Figures 8A, 8B, 8C:
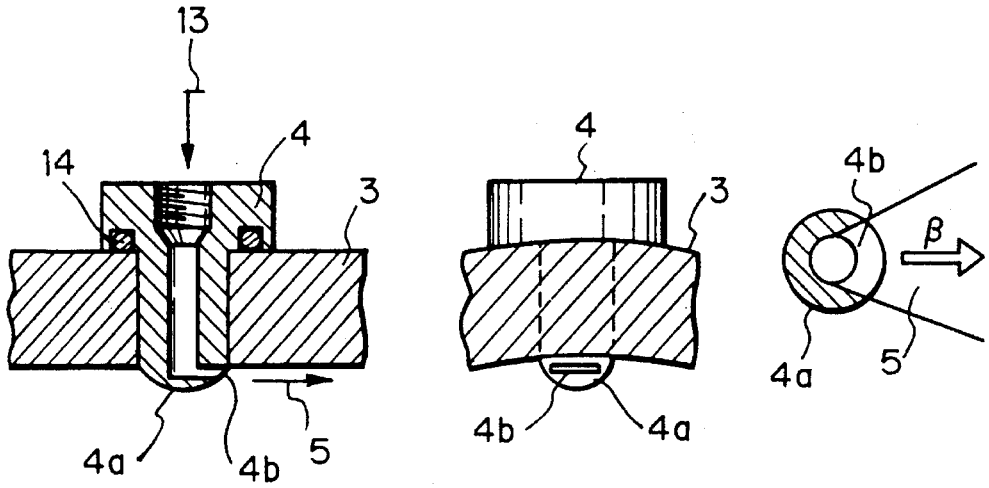
FIG. 8 shows a nozzle employed in the turbomachine according to the present invention, in which FIG. 8(*a*) is a vertical sectional view, FIG. 8(*b*) is a front view, and FIG. 8(*c*) is a horizontal sectional view of the nozzle head.

FIG. 8 shows an example of the configuration of nozzles 4, in which FIG. 8(*a*) is a vertical sectional view, FIG. 8(*b*) is a front view, and FIG. 8(*c*) is a horizontal sectional view of the nozzle head.

The nozzle head 4*a* has a hemispherical shape to prevent the flow from being disturbed by the head of nozzle 4 projecting from being disturbed by the head of nozzle 4 projecting from the inner surface of the casing 3. A high-pressure fluid supplied from a high-pressure source 13 is jetted from a nozzle outlet 4*b* in a direction β along the inner surface of the casing 3, with a velocity component counter to the direction α of rotation of the impeller 1. The nozzle 4 which is used in the present embodiment has a sectional configuration, as shown in FIG. 8, so that the injected jet 5 diverges. Such a nozzle configuration enhances the effectiveness of the invention.

It should be noted that reference numeral 14 in FIG. 8(*a*) denotes an O-ring for preventing water from leaking through the area between the nozzle 4 and the casing 3. A jet injected from such a nozzle diverges while mixing with the surrounding fluid and diffusing. The angle of divergence is about 6 degrees at one side (Trentacoste, N. and Sforza, P. M., 1966. As experimental investigation of three-dimensional free mixing in incompressible turbulent free jets. Rep. 81, Department of Aerospace Engineering, Polytechnic Institute of Brooklyn, New York). Accordingly, it is considered that even in a case where the direction of jet injection extends downwardly at about 6 degrees to the circumferential direction of the inner wall surface of the casing, the jets reattach to the casing inner wall surface again to form a flow layer flowing along the inner wall surface. Therefore, there will be no large adverse effect such as that shown in FIG. 20. On the other hand, when jets are injected toward the casing inner wall, the jets collide against the inner wall surface and then form a flow layer flowing along the wall surface. Therefore, no large adverse effect will be produced unless the jets are injected with such a large angle that the jets disperse and fail to form a flow layer. Accordingly, the jets need not be injected strictly parallel to the casing inner wall surface. The above-described effectiveness of the present invention can be obtained as long as the jets are injected substantially parallel to the inner wall surface.

Figure 9:
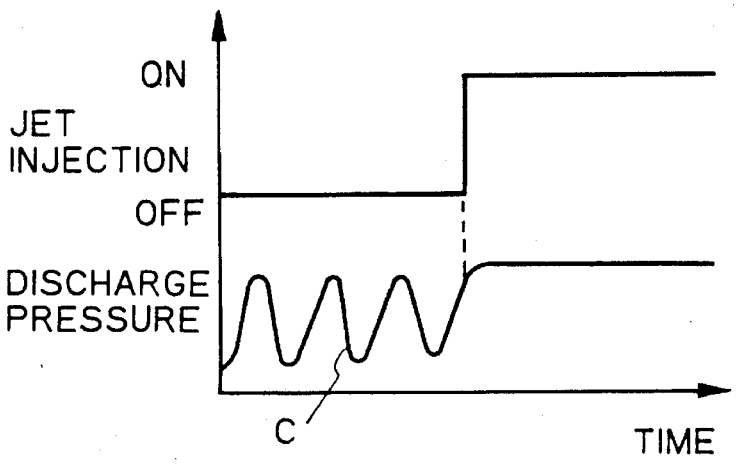
FIG. 9 shows one example of jet injection control in the turbomachine according to the present invention.
Figure 10:
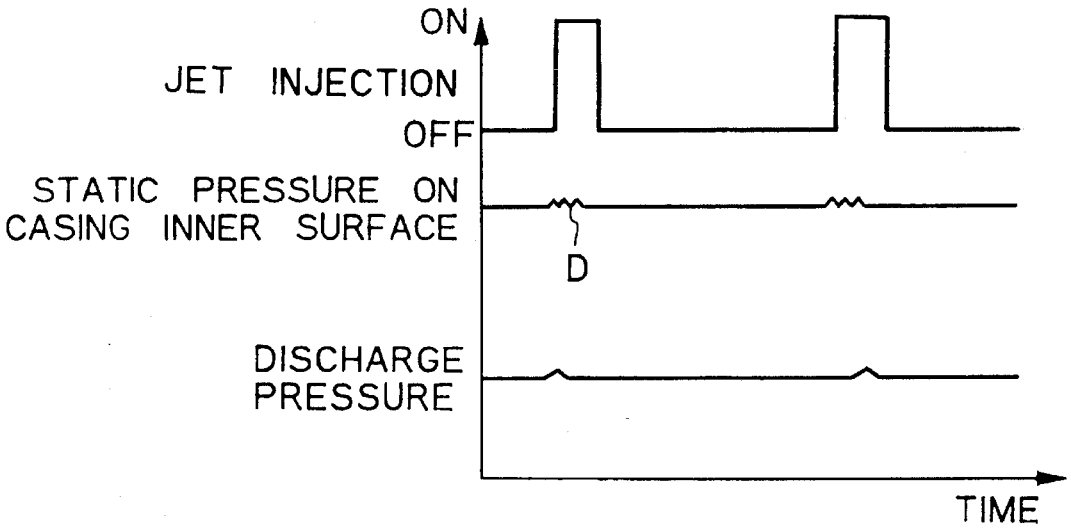
FIG. 10 shows another example of jet injection control in the turbomachine according to the present invention.

FIGS. 9 and 10 show examples of injection control of the jets 5. As illustrated, the easiest and simplest operating method is to inject the jets 5 continuously when surge C occurs, as shown in FIG. 9. It is also possible to execute intermittent control as shown in FIG. 10. That is, when a precursor D of stall (large-scale separation of flow) of the impeller 1 or a surge phenomenon, which will cause unstable pump characteristics, is detected (or when the occurrence of such a phenomenon is detected), jets 5 are injected for only a predetermined period of time to prevent the creation of unstable characteristics, and no jets 5 are injected until another precursor D of similar unstable characteristics is detected. With this intermittent control, it is possible to minimize the energy consumed.

The precursor D of unstable characteristics may be detected by various methods that use a pressure sensor installed on the casing 3 or other pump passage surface or inside the nozzle 4, or fluid noise, abnormal noise of the machine, vibration of the machine, or a change in the velocity in the passage.

Figure 11:
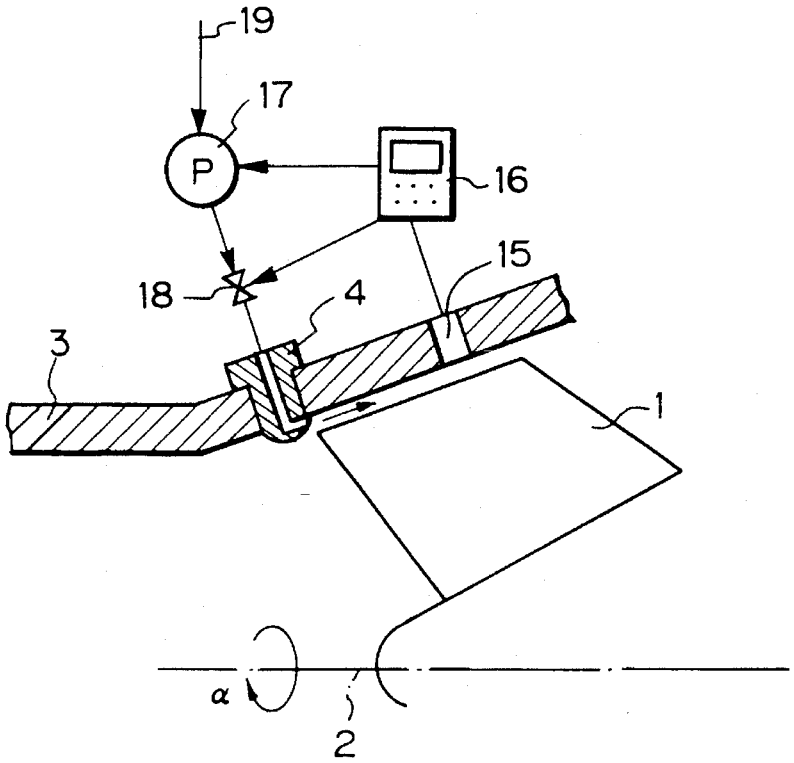
FIG. 11 shows one example of the turbomachine according to the present invention.
Figure 12:
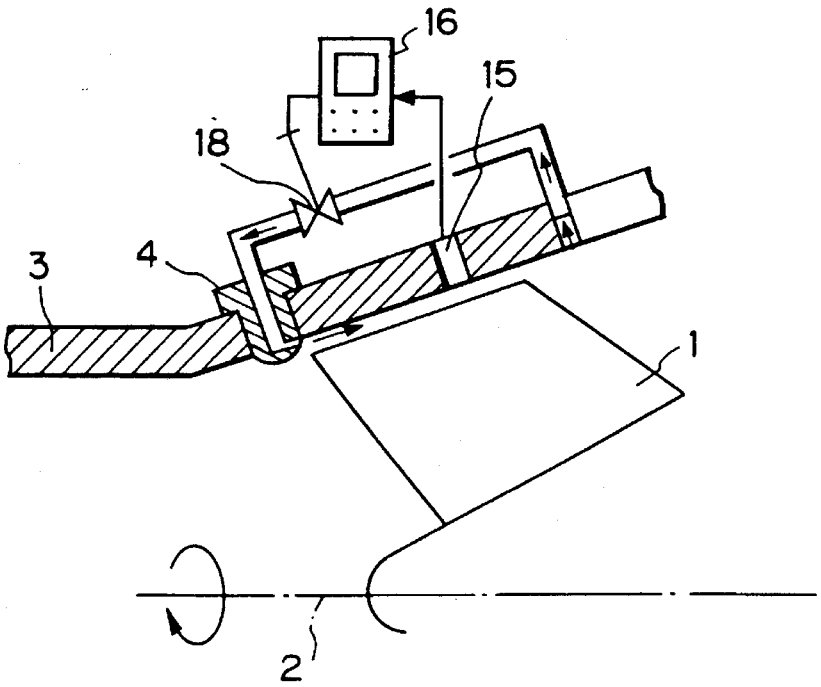
FIG. 12 shows another example of the turbomachine according to the present invention.

FIGS. 11 and 12 show examples of the turbomachine according to the present invention. In FIG. 11, a nozzle 4 is supplied with a fluid from an external fluid source (e.g., tap water) through a booster pump 17 and a solenoid valve 18. A signal from a pressure sensor 15 on the casing 3 is analyzed in a data processor 16. When unstable characteristics are predicted, jets are injected intermittently or continuously by controlling the booster pump 17 and the solenoid valve 18.

FIG. 12 shows an embodiment in which fluid is supplied from the pump discharge part, and the discharge pressure of the pump itself is employed in place of the booster pump 17. This embodiment is seemingly similar to the conventional method in which the flow is bypassed from the pump discharge part.

In the conventional bypass method, however, the creation of unstable characteristics is prevented by increasing the actual operating capacity, and the pump head inevitably lowers by a large amount. On the other hand, in the present invention, the total jet capacity required is about 1% of the pump discharge capacity, so that there will be no lowering of the pump head. Thus, the function of the present invention is basically different from that of the conventional method in which a large amount of discharge flow is bypassed.

In addition, the present invention enables the pump operation to be stabilized by much less energy than in the conventional method in which the creation of an unstable condition is prevented by bypassing. Although the examples shown in FIGS. 11 and 12 employ the pressure sensor 15, the stabilization of the pump operation can be realized without using such a pressure sensor 15. That is, if head characteristics (for example, see FIG. 15) measured in advance are stored in the memory of the data processor 16, jets can be injected continuously only when the pump is operated in the range 23, shown in FIG. 15, in which control is needed, by monitoring the capacity.

Figure 13:
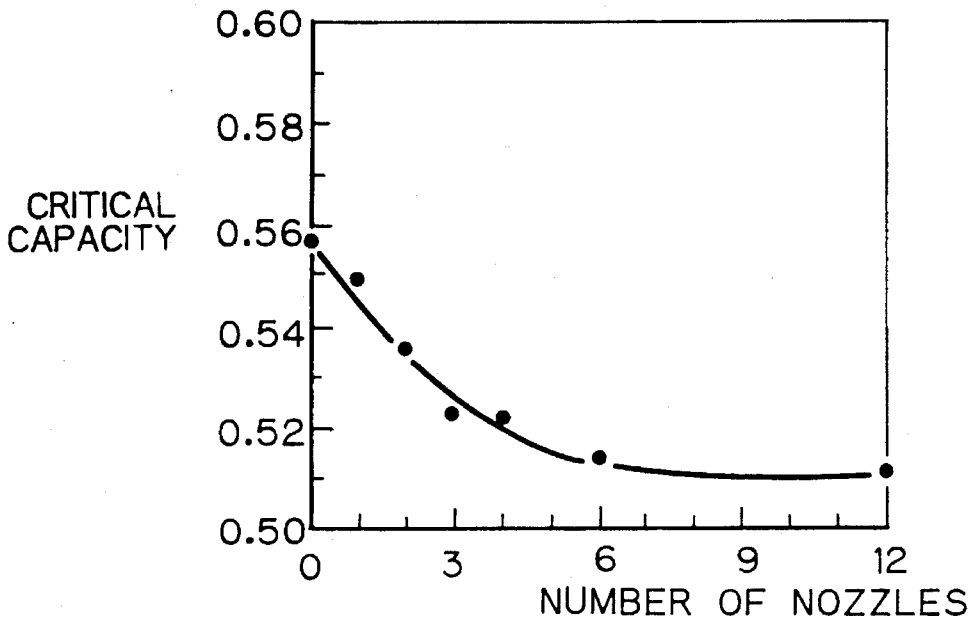
FIG. 13 shows the relationship between the number of nozzles provided in the inlet part of the impeller of the turbomachine according to the present invention and the effectiveness thereof.

FIG. 13 shows the relationship between the number of nozzles provided in the inlet part of the impeller 1 of a turbomachine and the effectiveness thereof. In this experiment, 12 nozzles, each having a valve, were equally spaced around the suction port (inner diameter: 250 mm), and capacities at which positively-sloped head-capacity characteristics were observed were determined in connection with various numbers of nozzles, the variation in the numbers of nozzles being effected by opening and closing the valves. As the number of nozzles increases, the critical capacity at which positively-sloped head-capacity characteristics occur decreases, that is, the effectiveness of the jets is enhanced. In this experiment, the effectiveness of the present invention does not change once the number of nozzles exceeds 6.

Figure 14:
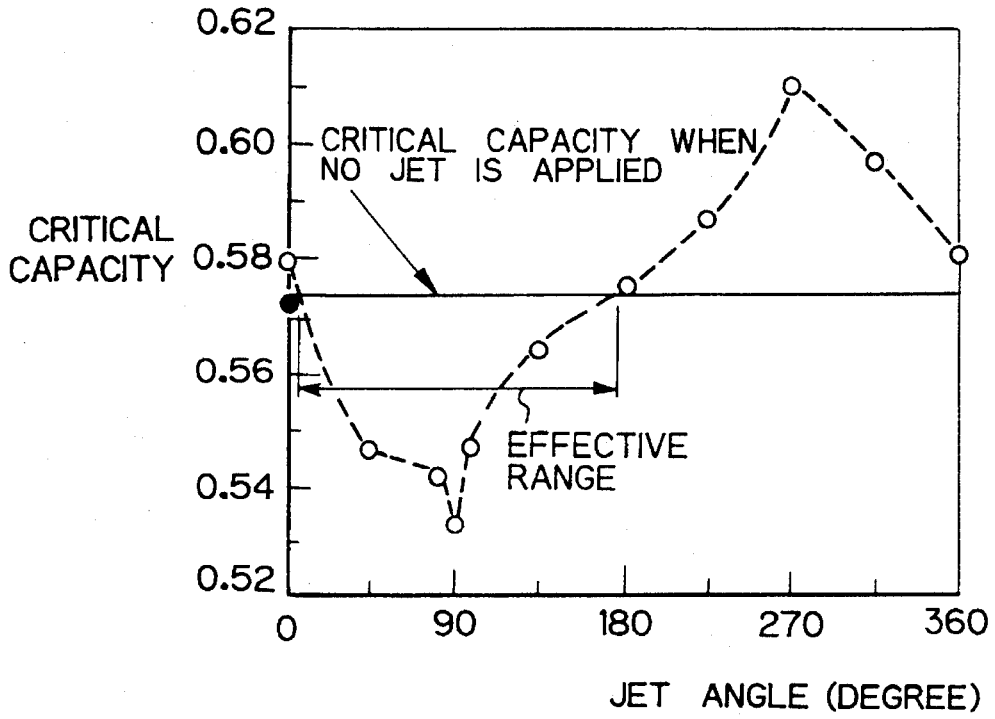
FIG. 14 shows the relationship between the direction of jet injection and the effectiveness thereof.

FIG. 14 shows the relationship between the direction of jet injection and the effectiveness thereof. It will be understood from the figure that the jet injection is effective only when the jets are injected with an angle in the range of 0 to 180 degrees measured from the axial direction, that is, only when the jets are injected with a velocity component counter to the direction of rotation of the impeller; particularly, when the jet injection angle is 90 degrees. That is, when the jets are injected counter to the direction of the impeller rotation, the largest effectiveness is obtained.

The direction of jets in which a vortex whirling counter to the direction of the impeller rotation can be introduced into the flow field most effectively is a direction perpendicular to the inlet flow, as has been stated in connection with the description of FIG. 16. In this embodiment, the inlet flow enters in the axial direction. Therefore, in the experiment shown in FIG. 14, the largest effectiveness was obtained at a jet angle of 90 degrees.

Figure 18:
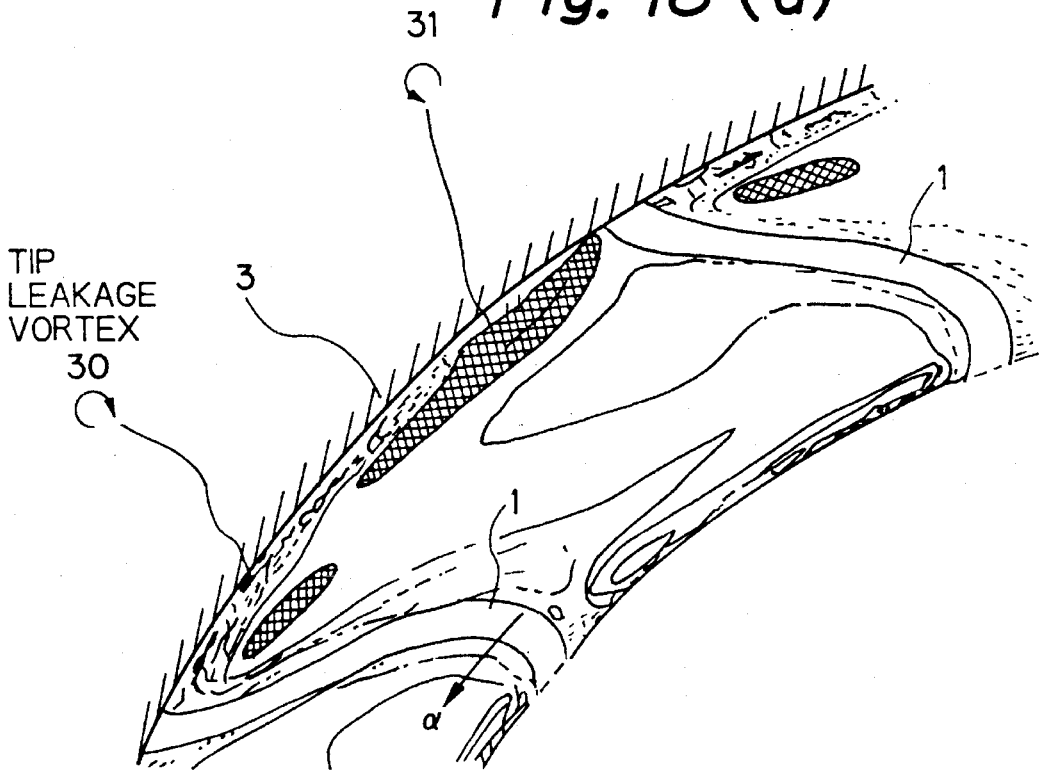
FIG. 18 shows a vorticity (vortex intensity) distribution in the impeller passage simulated by a viscous flow computation at a position equivalent to that shown in FIG. 3(*b*) (C—C section)
Figure 18:
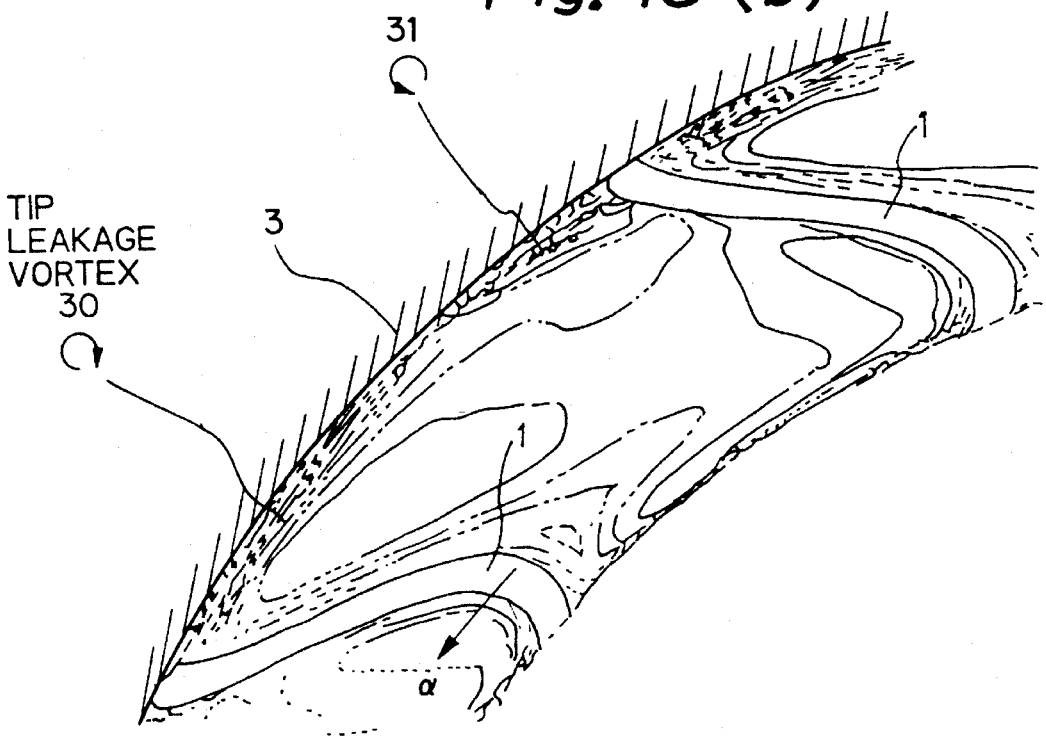
Figure 19:
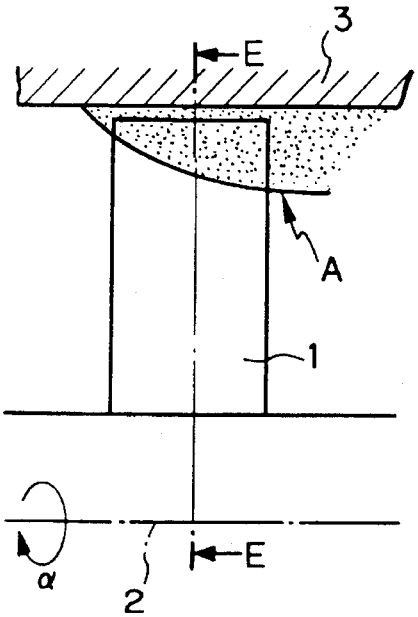
Fig. 19 (a) PRIOR ART
FIG. 19 shows a phenomenon occurring in a conventional turbomachine, in which FIG. 19(*a*) is a sectional view taken along a meridional plane, and FIG. 19(*b*) is a sectional view taken along line E—E in FIG. 19(*a*)
Figure 19:
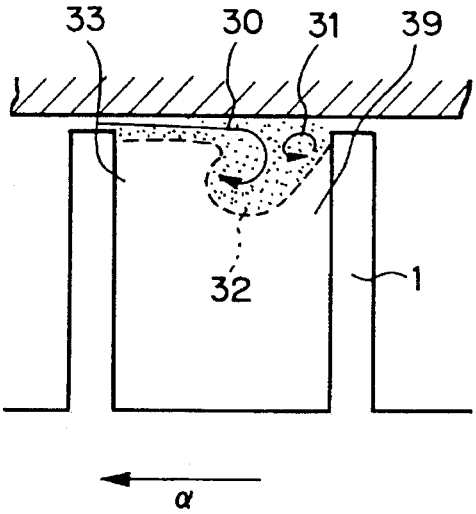
Fig. 19 (b) PRIOR ART

FIG. 18 shows a vortex intensity distribution in the impeller passage simulated by analysis of a viscous flow at a position equivalent to that shown in FIG. 3(*b*) (C—C section). In the figure, the vorticity (intensity) of a vortex whirling in the same direction as the direction of the impeller rotation is shown by contours of solid lines, while the vorticity of a vortex whirling counter to the direction of the impeller rotation is shown by contours of dot-dash-lines.

FIG. 18(*a*) shows the vorticity distribution in a conventional impeller, while FIG. 18(*b*) shows the vorticity distribution in an arrangement in which an annular flow layer is formed in the impeller inlet by injecting jets in the vicinity of the casing 3. Regions of the passing vortex 31 that have the same vorticity are hatched. It will be confirmed that the intensity of the passage vortex 31 is suppressed considerably by introducing a vortex whirling counter to the direction of the impeller rotation by the mechanism shown in FIG. 16.

As has been described above, it is possible according to the embodiment to suppress the development of the passage vortex 31 and prevent a large-scale separation of flow in the corner region 33. As a result, the positively-sloped head-capacity characteristics 9, which have heretofore been observed during the operation of the pump at partial capacity, are completely eliminated, as shown in FIG. 6, and the pump can be operated stably over the entire capacity range.

Figure 15:
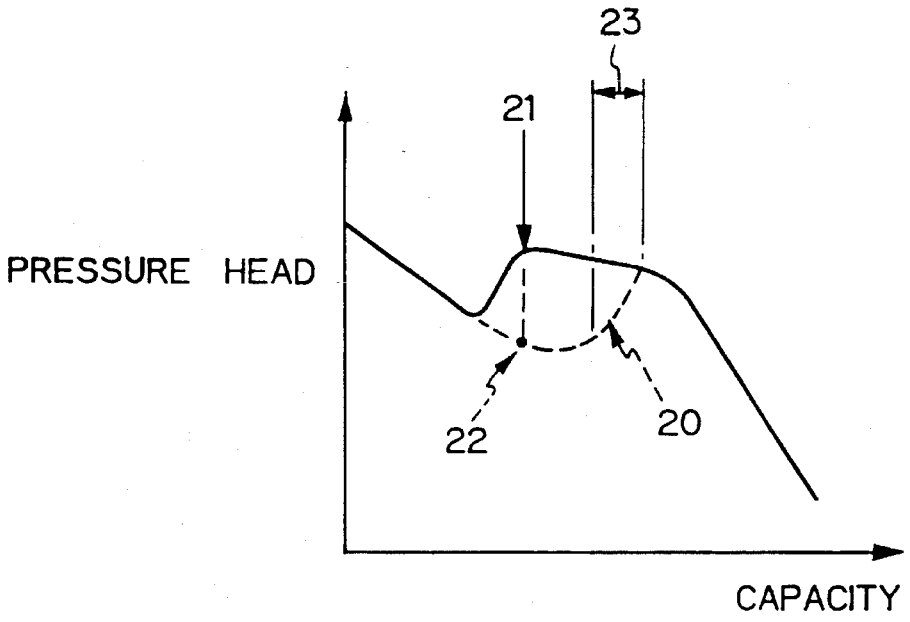
FIG. 15 shows one example in which the head-capacity curve falls markedly.

When the head-capacity curve falls markedly as shown by 20 in FIG. 15, the positively-sloped region cannot be completely eliminated. Moreover, the critical capacity 21 at which unstable characteristics would begin to occur due to the use of jets is lower. That is, in this case, there is a possibility of the pump exhibiting unstable characteristics when the jets are injected. However, if the injection of jets is stopped at this point (critical capacity), the pump characteristics move to the point 22 on the original, stable head-capacity curve. Therefore, the pump will not run into a state of surge. Accordingly, the region which governs when the stabilization by jets is required is limited to the capacity range 23 in FIG. 15, in which the head-capacity curve is positively-sloped.

In addition, the pump whose operation in the region shown by 23 in FIG. 15 has been stabilized by the present invention has stable characteristics over the entire capacity range. Thus, it is possible to form a surge-free pump piping system.

Although in the foregoing embodiment the present invention has been described by way of one example in which it is applied to a mixed flow pump, it should be noted that the present invention is not necessarily limited to such a mixed flow pump and that it can be applied to general turbomachines including axial flow type turbomachines, as a matter of course.

As has also been described above, according to the present invention, an annular flow layer flowing circumferentially along the casing inner surface in the impeller inlet part is formed, whereby it is possible to control the secondary flow inside the impeller, and prevent conditions giving rise to positively-sloped characteristics of the head-capacity curve of a turbomachine or improve the characteristics. Hence, it is possible to prevent surging and to stabilize the turbomachine operation over the entire capacity range.

I claim:

1. A mixed flow turbomachine comprising: a casing and an impeller disposed in said casing, said casing defining an inlet through which a fluid is introduced, said casing including a casing wall having an inner surface defining a space in which an inlet flow is confined to flow from the inlet to said impeller, and said impeller having an inlet end at which the inlet flow is first received by the impeller; and injecting means for injecting, at a location adjacent the inlet end of said impeller in the direction of flow of said inlet flow, at least one jet in a direction counter to the direction of rotation of the impeller and so parallel to the casing wall that said at least one jet forms an annular layer of fluid flowing along the inner surface of said casing in a direction substantially perpendicular to and bounding said inlet flow.

2. A mixed flow turbomachine as claimed in claim 1, wherein said injecting means comprises at least two nozzles each projecting from the inner surface of said casing wall and having an outlet located adjacent said inner surface, the outlet of each of said nozzles being so oriented that the vector of the velocity of the jet injected from said outlet has a major component extending along the inner surface of said casing wall.

3. A mixed flow turbomachine as claimed in claim 1, wherein said casing defines a discharge port located downstream of said location at which the jet is injected and communicating with the interior of said casing, and a bypass passage connecting said discharge port to said injecting means.

4. A mixed flow turbomachine as claimed in claim 2, wherein said casing defines a discharge port located downstream of said location at which the jet is injected and communicating with the interior of said casing, and a bypass passage connecting said discharge port to said nozzles.

5. A mixed flow turbomachine as claimed in claim 1, and further comprising a source of high-pressure fluid disposed outside of said casing and connected to said injecting means.

6. A mixed flow turbomachine as claimed in claim 2, and further comprising a source of high-pressure fluid disposed outside of said casing and connected to said nozzles.

7. A mixed flow turbomachine as claimed in claim 1, and further comprising sensor means for sensing operating conditions of the turbomachine indicative of an unstable operation of the turbomachine, and control means operatively connected to said sensor means and said injecting means for processing information, sensed by said sensor means and for controlling, based on the processing of said information the frequency at which the injection of said at least one jet by said injecting means is carried out.

8. A mixed flow turbomachine as claimed in claim 2, and further comprising sensor means for sensing operating conditions of the turbomachine indicative of an unstable operation of the turbomachine, and control means operatively connected to said sensor means and said nozzles for processing information sensed by said sensor means and for controlling, based on the processing of said information, the frequency at which the injection of said at least one jet by said nozzles is carried out.

9. An axial flow turbomachine comprising: a casing and an impeller disposed in said casing, said casing defining an inlet through which a fluid is introduced, and said casing including a casing wall having an inner surface defining a space in which an inlet flow is confined to flow from the inlet to said impeller, and said impeller having an inlet end at which the inlet flow is first received by the impeller; and injecting means for injecting, at a location adjacent the inlet end of said impeller in the direction of flow of said inlet flow, at least one jet in the direction of rotation of the impeller and so parallel to the casing wall that said at least one jet forms an annular layer of fluid flowing along the inner surface of said casing in a direction substantially perpendicular to and bounding said inlet flow.

10. An axial flow turbomachine as claimed in claim 9, wherein said injecting means comprises at least two nozzles each projecting from the inner surface of said casing wall and having an outlet located adjacent said inner surface, the outlet of each of said nozzles being so oriented that the vector of the velocity of the jet injected from said outlet has a major component extending along the inner surface of said casing wall.

11. An axial flow turbomachine as claimed in claim 9, wherein said casing defines a discharge port located downstream of said location at which the jet is injected and communicating with the interior of said casing, and a bypass passage connecting said discharge port to said injecting means.

12. An axial flow turbomachine as claimed in claim 10, wherein said casing defines a discharge port located downstream of said location at which the jet is injected and communicating with the interior of said casing, and a bypass passage connecting said discharge port to said nozzles.

13. An axial flow turbomachine as claimed in claim 9, and further comprising a source of high-pressure fluid disposed outside of said casing and connected to said injecting means.

14. An axial flow turbomachine as claimed in claim 10, and further comprising a source of high-pressure fluid disposed outside of said casing and connected to said nozzles.

15. An axial flow turbomachine as claimed in claim 9, and further comprising sensor means for sensing operating conditions of the turbomachine indicative of an unstable operation of the turbomachine, and control means operatively connected to said sensor means and said injecting means for processing information sensed by said sensor means and for controlling, based on the processing of said information, the frequency at which the injection of said at least one jet by said injecting means is carried out.

16. An axial flow turbomachine as claimed in claim 10, and further comprising sensor means for sensing operating conditions of the turbomachine indicative of an unstable operation of the turbomachine, and control means operatively connected to said sensor means and said nozzles for processing information sensed by said sensor means and for controlling, based on the processing of said information, the frequency at which the injection of said at least one jet by said nozzles is carried out.

17. A method of stabilizing the operation of a mixed flow turbomachine having a casing defining an inlet through which fluid is introduced and including a casing wall having an inner surface defining a space through which an inlet flow of the fluid is confined to flow from the inlet, and an impeller disposed in the casing and having an inlet end at which the inlet flow of fluid is first received by the impeller, said method comprising:

injecting, at a location adjacent the inlet end of the impeller, at least one jet in a direction counter to the direction of rotation of the impeller and so parallel to the casing wall that said at least one jet forms an annular layer of fluid flowing along the inner surface of said casing in a direction substantially perpendicular to and bounding said inlet flow.

18. A method of stabilizing the operation of a mixed flow turbomachine as claimed in claim 17, wherein the at least one jet is injected continuously.

19. A method of stabilizing the operation of a mixed flow turbomachine as claimed in claim 17, wherein the at least one jet is injected intermittently.

20. A method of stabilizing the operation of a mixed flow turbomachine as claimed in claim 17, and further comprising sensing operating conditions of the turbomachine indicative of an unstable operation of the turbomachine, and controlling the frequency at which the at least one jet is injected based on said sensing.

21. A method of stabilizing the operation of a mixed flow turbomachine as claimed in claim 17, and further comprising detecting a precursor of conditions giving rise to the occurrence of a positive slope, indicative of unstable operation, in the head-capacity curve of the turbomachine, and controlling the frequency at which the at least one jet is injected based on results of said detecting.

22. A method of stabilizing the operation of an axial flow turbomachine having a casing defining an inlet through which fluid is introduced and including a casing wall having an inner surface defining a space through which an inlet flow of the fluid is confined to flow from the inlet, and an impeller disposed in the casing and having an inlet end at which the inlet flow of fluid is first received by the impeller, said method comprising:

injecting, at a location adjacent the inlet end of the impeller, at least one jet in the direction of rotation of the impeller and so substantially parallel to the casing wall that said at least one jet forms an annular layer of fluid flowing along the inner surface of said casing in a direction substantially perpendicular to and bounding said inlet flow.

23. A method of stabilizing the operation of an axial flow turbomachine as claimed in claim 22, wherein the at least one jet is injected continuously.

24. A method of stabilizing the operation of an axial flow turbomachine as claimed in claim 22, wherein the at least one jet is injected intermittently.

25. A method of stabilizing the operation of an axial flow turbomachine as claimed in claim 22, and further comprising sensing operating conditions of the turbomachine indicative of an unstable operation of the turbomachine, and controlling the frequency at which the at least one jet is injected based on said sensing.

26. A method of stabilizing the operation of an axial flow turbomachine as claimed in claim 22, and further comprising detecting a precursor of conditions giving rise to the occurrence of a positive slope, indicative of unstable operation, in the head-capacity curve of the turbomachine, and controlling the frequency at which the at least one jet is injected based on results of said detecting.

* * * * *